United States Patent [19]

Reutter

[11] 3,946,526

[45] Mar. 30, 1976

[54] TOOL FOR REFACING VALVE SEATS ON FAUCETS OR THE LIKE

[76] Inventor: John W. Reutter, 29 W. 41st St., Wilmington, Del. 19802

[22] Filed: Feb. 18, 1975

[21] Appl. No.: 550,701

[52] U.S. Cl. ..... 51/241 VS
[51] Int. Cl.[2] ..... B24B 15/02
[58] Field of Search ..... 51/241 VS, 71, 134.5 R; 90/12.5; 173/163; 46/70

[56] References Cited

UNITED STATES PATENTS

| | | | |
|---|---|---|---|
| 750,301 | 1/1904 | Philius | 51/134.5 R |
| 1,663,420 | 3/1928 | Stoll | 51/241 VS X |
| 1,701,329 | 2/1929 | McIntosh | 51/241 VS |
| 1,924,958 | 8/1933 | Patterson | 51/241 VS |
| 2,006,630 | 7/1935 | Dutro | 51/241 VS |
| 2,435,364 | 2/1948 | Pearson | 46/70 |
| 2,454,068 | 11/1948 | Kuhlman | 51/241 VS |
| 2,514,155 | 7/1950 | Fisher | 51/134.5 R |

*Primary Examiner*—Al Lawrence Smith
*Assistant Examiner*—Nicholas P. Godici
*Attorney, Agent, or Firm*—Shlesinger, Arkwright, Garvey & Dinsmore

[57] ABSTRACT

A tool for refacing valve seats of faucets or the like which includes a shaft to one end of which is affixed an abrasive member adapted to engage the valve seat for refacing the same. A cap is placed over, and is rotatable with respect to, the opposite end of the shaft, the cap being manually held to exert pressure on the tool in the direction of the valve seat. A spool is engaged with the shaft intermediate its length and is rotatable therewith. A flexible cord is wound around the spool and, upon quickly pulling the same from the spool, the spool and shaft are rapidly rotated to effect a corresponding rotation of the abrasive member to effect refacing of the valve seat.

5 Claims, 6 Drawing Figures

TOOL FOR REFACING VALVE SEATS ON FAUCETS OR THE LIKE

BACKGROUND AND OBJECTS

It frequently occurs that valve seats of faucets become cut, pitted or otherwise damaged after a period of use, thereby causing the faucet to leak. In order to correct this problem, various tools have been developed for refacing the valve seat in situ, such as disclosed in U.S. Pat. Nos. 2,598,765, 2,748,747, 2,787,196 and 2,833,093.

In all of these tools, an abrasive member in contact with the valve seat is manually rotated to effect refacing of the valve seat. In view of the fact that the abrasive member is rotated in response to hand rotation of a shaft member which supports the abrasive member, the speed with which the shaft and abrasive member can be rotated is necessarily limited. Consequently, the refacing of the valve seat is a slow, tedious process.

It is an object of this invention to provide a hand-operated tool for refacing valve seats in situ which is capable of efficiently and rapidly refacing the valve seat.

Another object is to provide a tool of the character described including a shaft to one end of which is affixed an abrasive member, a spool engaged with the shaft and rotatable therewith, and a flexible cord wrapped around the spool for the purpose of effecting a rapid rotation of the shaft and abrasive member upon pulling the cord from the spool.

A further object is to provide a tool of the character described which is of simple, economical construction and may be manufactured in a variety of sizes and of any desired material.

Other objects will be apparent from the following description of the presently preferred forms of this invention, taken in connection with the appended drawings.

DETAILED DESCRIPTION OF FORM OF INVENTION ILLUSTRATED IN FIGS. 1 TO 4

Figure 1:
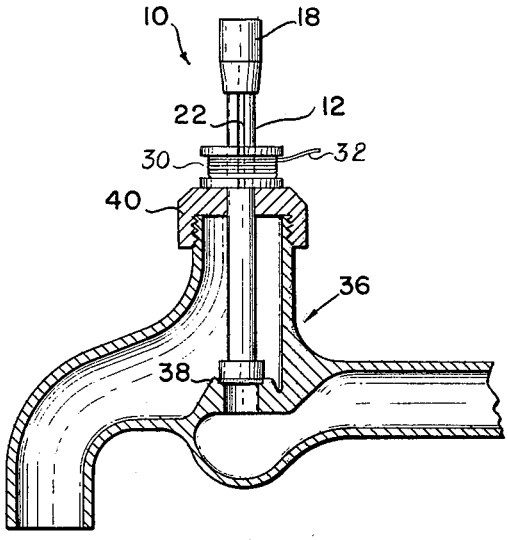
FIG. 1 is a plan view of the tool of the present invention, illustrating its application.
Figure 2:
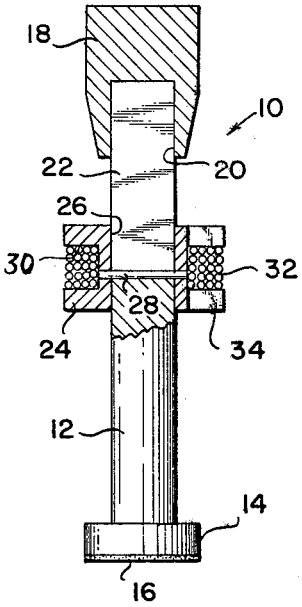
FIG. 2 is an enlarged longitudinal sectional view of the tool of the present invention, a portion thereof being shown in elevation.
Figure 3:
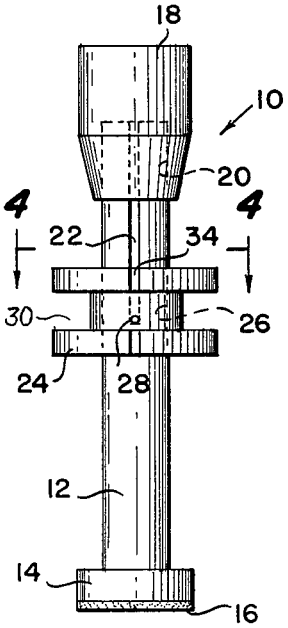
FIG. 3 is a side elevational view of the present tool.
Figure 4:
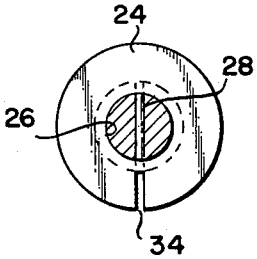
FIG. 4 is a sectional view taken along the line 4—4 of FIG. 3, looking in the direction of the arrows.

In FIGS. 1 to 4, there is illustrated a hand tool constructed in accordance with the present invention which is generally designated 10. Tool 10 may be of wood, metal or plastic construction and includes an elongated rectilinear shaft 12 which is preferably of circular cross-section. A rigid disc 14 is fixedly engaged with one terminal of shaft 12 by an adhesive or other suitable means. An abrasive disc 16 is adhesively secured to the outer face of disc 14. A handle or cap 18, having a recess or socket 20 is adapted to receive the free end of shaft 12, socket 20 being of a size to permit free rotation of shaft 12 with respect to the cap.

As shown to advantage in the drawings, shaft 12 is provided with a diametric slot 22 extending from the terminal of the shaft to a point remote therefrom. In conjunction with slot 22, there is provided a spool 24 having a central bore 26 which is substantially the same diameter of shaft 12 and adapted to be placed thereover. A pin 28 extends diametrically through bore 26 of spool 24, which pin is adapted to be received by slot 22 of shaft 12 when the spool is engaged with the shaft as shown to advantage in FIG. 4.

Spool 24 is provided with a peripheral annular recess 30 adapted to receive a flexible cord 32 which is wound around spool 24 within recess 30 a number of times, the inner end of the cord being received in slot 34 of spool 24 for facility in winding.

OPERATION

Tool 10 of the present invention is adapted for use with a conventional type faucet 36 such as illustrated in FIG. 1, which faucet includes a valve seat 38 and a bonnet 40 which is in threaded engagement with the upper end of the faucet.

In use of the tool of the present invention, the faucet handle and bonnet are initially removed to permit tool 10 to be placed within the faucet, with abrasive disc 16 in engagement with valve seat 38. Bonnet 40 is then threadedly engaged with the faucet, following which spool 24 and cap 18 are engaged with shaft 12, as shown in FIG. 1.

Flexible cord 32 is next wound around spool 24 within groove 30, a winding of approximately 14 turns having been found to give optimum results. Thumb pressure is then exerted on cap 18 in the direction of valve seat 38, following which flexible cord 32 is quickly pulled to produce a rapid rotation of spool 24 and shaft 12, with resultant abrading engagement of disc 16 with the valve seat. This operation is repeated several times to complete the refacing of the valve seat.

Figure 5:
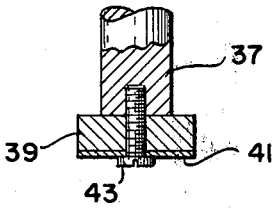
FIG. 5 is a fragmentary sectional view showing a modified form of an abrasive member.

In FIG. 5, there is illustrated a modified form of the present invention wherein the disc and abrasive member are detachably engaged with the shaft of the tool in order to allow ready replacement of the disc and abrasive member when needed. In this form of the invention, the shaft is indicated at 37, the disc is designated 39 and the abrasive member 41. Abrasive member 41 is adhesively secured to disc 39 and a screw member 43 permits the disc and abrasive member to be attached to, and removed from, the shaft for ready replacement.

Figure 6:
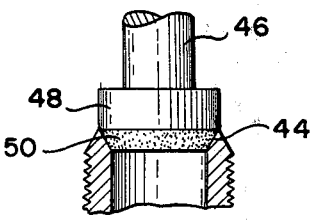
FIG. 6 is a fragmentary elevational view of a modified form of the present invention, illustrating its application to a valve having a bevelled seat.

In FIG. 6 there is illustrated a still further modification of the present invention which is adapted for refacing a concave valve seat indicated at 44. For this purpose, there is provided a shaft 46 which is similar to shaft 12 of the main form of the present invention, to one end of the shaft is secured a disc 48, a portion of which is beveled to receive an abrasive member 50 which is adhesively secured to the beveled portion for engagement with the concave seat as shown in FIG. 6.

The tool of the present invention comprises a few readily assembled parts which may be economically manufactured in a variety of sizes to reface different sizes and shapes of valve seats. By means of this invention also, the refacing operation may be quickly and efficiently carried out by the expedient of placing the thumb of one hand on the cap of the tool and pulling the flexible cord surrounding the spool with the other hand to produce the required rapid rotation of the abrasive member.

While there has been herein shown and described the presently preferred forms of this invention, it is to be understood that such has been done for purposes of illustration only and that various changes may be made therein within the scope of the appended claims.

What is claimed is:

1. A tool for refacing the valve seat of a faucet or the like, including:

a. a shaft, b. an abrasive member secured to one end of said shaft and adapted for engagement with the valve seat, c. the free end of said shaft being provided with a transverse, elongated longitudinal slot extending from the terminal thereof to a point intermediate the length of the shaft, d. a spool including a bore through which said shaft passes, e. a pin extending diametrically through the bore of said spool, f. said pin being disposed in the longitudinal slot of said shaft, whereby said shaft and spool are rotatable together, and g. a flexible cord wrapped around said spool to effect rotation of the spool and shaft and a corresponding rotation of said abrasive member against the valve seat upon pulling said flexible cord from the spool.

2. The tool of claim 1, with the addition of:

a. a cap, b. said cap having a recess for receiving the free end of said shaft, c. said shaft being rotatable with respect to said cap, whereby said cap may be manually engaged to exert pressure on the tool in the direction of the valve seat.

3. The tool of claim 2, wherein:

a. the outer periphery of said spool is provided with an annular recess adapted to receive said flexible cord.

4. The tool of claim 3, wherein:

a. said abrasive member includes a rigid disc, one face of which is fixedly secured to a terminal of said shaft, and b. an abrasive disc fixed to the outer face of said rigid disc.

5. The tool of claim 3, wherein:

a. said abrasive member includes a rigid disc, one face of which is removably secured to a terminal of said shaft, and b. an abrasive disc fixed to the outer face of said rigid disc.

* * * * *